United States Patent [19]

Mitchell

[11] 4,186,809

[45] Feb. 5, 1980

[54] STEEP ANGLE RAISE BIT

[75] Inventor: Howard E. Mitchell, Duncanville, Tex.

[73] Assignee: Dresser Industries, Inc., Dallas, Tex.

[21] Appl. No.: 958,299

[22] Filed: Nov. 6, 1978

[51] Int. Cl.[2] ..... E21B 9/24; E21C 23/00

[52] U.S. Cl. ..... 175/334; 175/53; 175/385

[58] Field of Search ..... 175/53, 334, 335,344, 175/385, 406; 403/57, 58

[56] References Cited

U.S. PATENT DOCUMENTS

| | | | |
|---|---|---|---|
| Re. 27,597 | 3/1973 | Talbert | 175/53 X |
| 3,231,029 | 1/1966 | Winberg | 175/53 |
| 3,894,402 | 7/1975 | Cherrington | 175/53 X |
| 3,917,009 | 11/1975 | Dyer et al. | 175/53 |
| 4,071,098 | 1/1978 | Dively et al. | 175/53 |

FOREIGN PATENT DOCUMENTS

| | | | |
|---|---|---|---|
| 2009590 | 9/1971 | Fed. Rep. of Germany | 175/335 |
| 2020202 | 11/1971 | Fed. Rep. of Germany | 175/53 |

*Primary Examiner*—Ernest R. Purser
*Assistant Examiner*—Nick A. Nichols, Jr.
*Attorney, Agent, or Firm*—Eddie E. Scott

[57] ABSTRACT

A raise bit for enlarging a pilot hole into a larger diameter hole by disintegrating the earth formations that surround the pilot hole is provided with a cutter arrangement that provides a continuous angle bottom configuration in the range of 134° to 60°.

2 Claims, 3 Drawing Figures

STEEP ANGLE RAISE BIT

FIELD OF THE INVENTION

The present invention relates to the art of earth boring and, more particularly, to a riase bit for boring large diameter raise holes by enlarging a pilot hole into the larger diameter hole.

BACKGROUND OF THE INVENTION

It is well known in the earth boring art to produce relatively large diameter holes between a first location and a second location in a mine or other underground works by operations commonly referred to as raise drilling. A raise drilling operation begins by drilling a small diameter pilot hole through the earth from a first location to an opening at a second location using a small diameter pilot bit. After the pilot hole is completed, the pilot bit is removed from the drill string and a large diameter raise bit is attached. The raise bit is rotated and drawn along the pilot hole thereby enlarging the pilot hole to the desired size.

Many strict requirements are imposed upon drill bits used in boring large diameter holes. The drill bit must be a balanced, high-performance apparatus that is rugged and will perform for a long period of time. Replaceable rolling cutters are located and spaced so that upon rotation of the drill bit every portion of the hole being drilled will be acted upon by one or more of the cutters in order to disintegrate the formations and form the desired large diameter hole. This insures that almost the entire wear in drilling takes place on the cutters rather than on the main bit body. The cutters are readily replaceable thereby allowing the life of the drill bit to be extended by replacing the individual cutters.

DESCRIPTION OF PRIOR ART

United States Department of the Interior, Bureau of Mines, Technical Report on Foster-Miller Associates, Inc., Contract H0210044, "Design, Fabricate And Test A Conical Borer" described a conical borer system.

In U.S. Pat. No. 3,633,691 to Milton L. Talbert, patented Jan. 11, 1972, a bit for drilling large diameter holes is shown. Cutters are arranged in a staged configuration around the central shaft. The innermost cutters are the same large cutters used at other locations on the bit allowing complete interchangeability. The innermost cutters are turned inward. This reduces the uncut bottom next to the pilot hole and provides a stronger bit because the central shaft has not been weakened by milling or other operations.

In U.S. Pat. No. 3,638,740 to Dan B. Justman, patented Feb. 1, 1972, a rotary drill for producing a raise bore including a body having roller cutter assemblies arranged to cut the working face of an earth formation so that the plane of an inner portion of the working face inclines downwardly and inwardly towards a pilot hole, and the plane of an outer portion of the working face inclines downwardly and outwardly towards the gage of the raise bore, and the plane of an intermediate portion of the working face extends between the inner and outer inclined portions is shown.

In U.S. Pat. No. 3,750,767 to Rudolf Carl Otto Pessier, patented Aug. 7, 1973, a reaming type rock boring drill having an innermost cutter, rotatably supported as a beam is shown. A sleeve or other support member disposed close to, but spaced apart from, the drill stem that forms a portion of the bit body serves as a trunnion or journal for the inner end of the load pin of the cutter bearing assembly. Drilling with such an assembly results in an uncontacted kerf of rock contiguous with the pilot hole. This kerf is disintegrated by mounting the innermost cutter so that the forces applied to the borehole bottom by this cutter act along a line directed into the formation and inwardly toward the pilot hole. As a result, a much higher cutting efficiency is achieved, when contrasted with earlier dispositions in which the innermost cutter acted directly on the bottom of the borehole immediately adjacent the pilot hole.

In U.S. Pat. No. 4,007,799 to Robert L. Dixon and Robert E. Allison, patented Feb. 15, 1977, a raise type of earth boring drill in which the cutter assembly is detachably secured to the drive stem to permit replacement of the stem is shown. The stem slidably engages a central opening in the cutter assembly, the cutter assembly engaging a shoulder on the stem which carries axial loads in the drill. The cutter assembly is detachably anchored by a plurality of bolts to a torque plate attached to the end of the stem for transmitting torque load to the cutter assembly, the bolts clamping the cutter assembly against the shoulder.

SUMMARY OF THE INVENTION

The present invention provides a raise bit for enlarging a pilot hole into a larger diameter hole by disintegrating the earth formations that surround the pilot hole. The bit includes a cutterhead with a multiplicity of rolling cutters for contacting and disintegrating the formations that surround the pilot hole. The cutterhead comprises a series of rolling cutters mounted so that the cutter face profile extends in a uniform manner to the edge of the pilot hole. The face profile of the cutters forms a conical shape. The included angle of the cone face profile is in the range of 134° to 60°. The above and other features and advantages of the present invention will become apparent from a consideration of the following detailed description of the invention when taken in conjunction with the accompanying drawings.

DETAILED DESCRIPTION OF THE INVENTION

Figure 1:
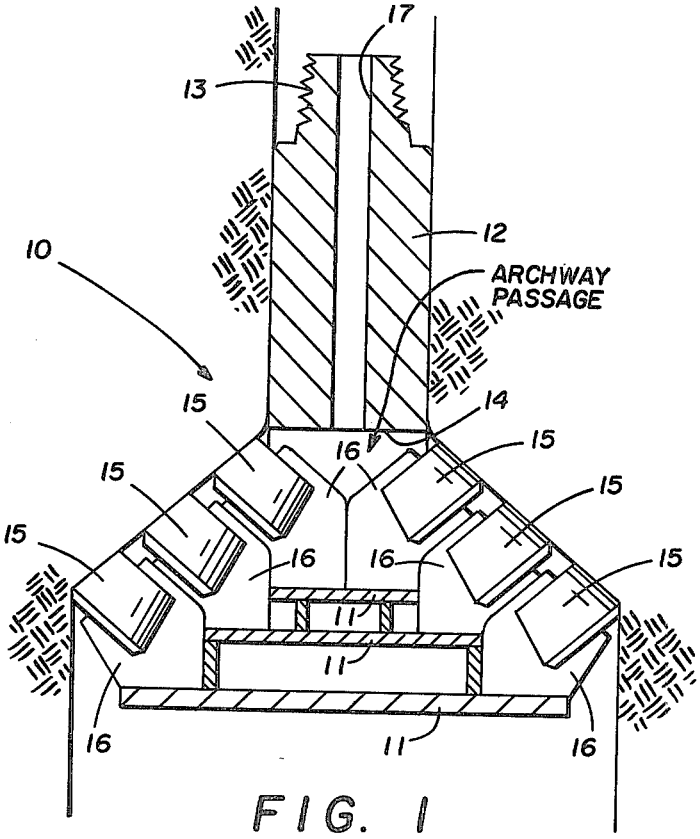
FIG. 1 is a side view partially in section of a raise bit constructed in accordance with the present invention.

Referring now to the drawings and, in particular, to FIG. 1, a raise bit constructed in accordance with the present invention is illustrated. The bit is generally designated by the reference number 10. A series of main plates 11 form the basic framework of the bit 10. A central drive stem 12 projects from the main plate 11. A central passage 17 in drive stem 12 allows drilling fluid (air) to be circulated through the bit 10. The upper portion 13 of the drive stem 12 is threaded to allow the bit 10 to be easily connected to, and disconnected from, a rotary drill string (not shown). A multiplicity of saddles 16 are mounted on the main plates 11 containing a corresponding multiplicity of rolling cutters 15. The rolling cutters 15 contact and disintegrate the formations surrounding the pilot hole during the raise drilling operation.

Drive stem 12 presents no interference to the center cutters because it attaches to the cutterhead body at points between the cutters after they have been placed in their most effective operating positions. The cutters can be placed as close together radially as their saddles will allow. The lower portion of the drive stem 12 includes extensions that reach over or "bridge" the inner legs of the center saddles 16 and extend into the available vacant areas between the saddles for attachment, for example by being welded or bolted, to the main plates 11. An archway 14 is thereby provided for the inner cutters. The saddles supporting the inner cutters fit into the archway and bring the cutting surfaces of the cutters to the pilot hole thereby eliminating uncut bottom. The drive stem 12 is attached to the cutterhead body without interfering in any way with the most effective operating position of the rolling cutters adjacent the stem. This cutter placement results in continuation of the same straight cutting profile that is produced by the other cutters. This eliminates profile changes which would result in premature wear. This reduces uncut bottom at the stem while maintaining the same profile.

Figure 2:
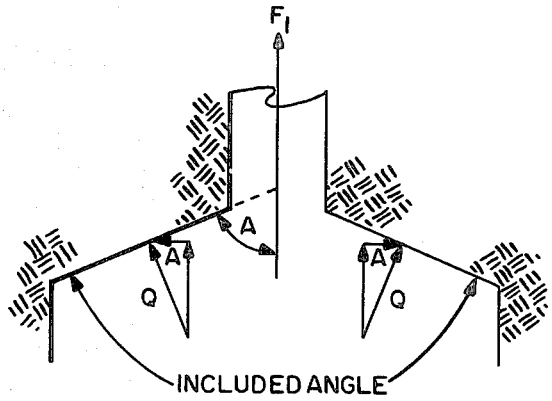
FIG. 2 PRIOR ART
FIG. 2 is an illustration of the cutter face profile of prior art raise bits.

The present invention provides a raise bit that incorporates a more effective cutter arrangement for improved drilling performance. Prior art raise bits used continuous angle bottom configurations utilizing included cone angles that ranged from approximately 180° (true flat bottom) to approximately 134°. This is illustrated in FIG. 2. Simple equations of statics show that as the included cone angle decreases, the total force Q normal to the cutting face increases in indirect proportion to the cosine of A half the included angle. However, the cone side, or the area being cut, is increased by the same factor. Thus the unit load, or pressure, remains constant. Therefore, the penetration rate is increased because a greater area of rock is being attacked at the same unit load per revolution. Thus, the efficiency of the raise boring operation is greatly increased. Other prior art raise bits used multiple profile angles or multiple cutter stages.

Figure 3:
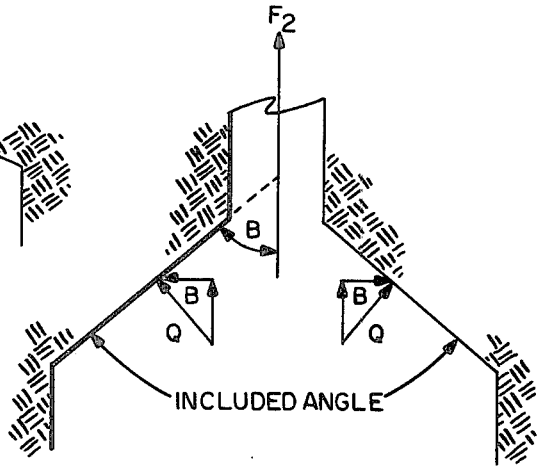
FIG. 3 is an illustration of the cutter face profile of the raise bit shown in FIG. 1.

Referring now to FIG. 3, the cutter face profile of the bit 10 shown in FIG. 1 is illustrated. The present invention provides a raise bit that incorporates a more effective cutter arrangement for improved drilling performance. The raise bit body is so designed to accommodate a number of rolling cutting elements arranged in a manner such that the face of the cutting elements form a conical shape, the included angle of which is in the range of 134° to 60°. The present invention provides a raise bit which generates sufficient stabilization from the cutting elements to eliminate the need for additional stabilizing elements. The included angle of raise bit 10 is substantially 100°.

Simple equations of statics show that as the included cone angle decreases, the total force Q normal to the cutting face increases in indirect proportion to the cosine of half B the included angle. However, the cone side, or the area being cut, is increased by the same factor. Thus the unit load, or pressure, remains constant. Therefore, the penetration rate is increased because a greater area of rock is being attacked at the same unit load per revolution. Thus, the efficiency of the raise boring operation is greatly increased. Further, assuming that the load per unit area can be decreased and still overcome the threshold strength of the formation being cut, and assuming that present penetration rates are acceptable, lower horsepower raise drilling machines may be utilized to achieve the same raise geometry as the present higher powered machines at an attendant cost savings. Or, under the same assumptions as above, raise geometry may be increased utilizing existing machines. In addition, the side loads on the cutters, or the loads normal to the axis of rotation, increase in direct proportion to the tangent of half B the included angle. These side loads are the loads which supply the centralization or stabilization of the raise head. Thus as the included angle decreases, the stabilizing forces increase, thereby improving the smooth running characteristics of the raise head and greatly increasing the life of the cutters, raise head stem, and associated drill string members.

The embodiments of the invention in which an exclusive property or privilege is claimed are defined as follows:

1. An earth boring bit for boring a large diameter hole by disintegrating the earth formations surrounding a pilot hole, comprising:

main plate means;

a pair of inner saddles mounted on said main plate means, said inner saddles positioned adjacent each other;

a pair of inner rolling cutters mounted in said pair of inner saddles;

a multiplicity of additional saddles mounted on said main plate means;

a multiplicity of additional rolling cutters mounted in said additional saddles; and a stem member for projecting into said pilot hole, said stem member having an archway passage and extensions extending from said archway passage that bridge said pair of inner rolling cutters with said extensions attached to said main plate means and said pair of inner saddles and said pair of inner rolling cutters located substantially within said archway passage with said pair of inner rolling cutters and said additional rolling cutters positioned to provide a continuous angle earth formation profile having a conical shape with an included angle within the range of 134° to 60°.

2. The raise bit of claim 1 wherein the included angle is substantially 100°.

* * * * *